United States Patent [19]

Yamakawa et al.

[11] Patent Number: 4,583,568

[45] Date of Patent: Apr. 22, 1986

[54] VALVE ASSEMBLY FOR POWDERY GRANULES

[75] Inventors: Takashi Yamakawa, Hirakata; Ikuhei Otani, Sakai; Morio Akiyama, Izumi, all of Japan

[73] Assignee: Kurimoto, Ltd., Osaka, Japan

[21] Appl. No.: 671,659

[22] Filed: Nov. 15, 1984

[30] Foreign Application Priority Data

Nov. 21, 1983 [JP] Japan ..... 58-219138

[51] Int. Cl.[4] ..... B08B 3/04; B08B 9/00; F16K 25/02

[52] U.S. Cl. ..... 137/240; 251/58; 251/172; 251/174; 251/175; 251/229; 251/298; 277/164

[58] Field of Search ..... 137/238, 240, 242; 251/58, 172, 173, 175, 229, 298, 174

[56] References Cited

U.S. PATENT DOCUMENTS

| | | | |
|---|---|---|---|
| 1,311,442 | 7/1919 | Gilfillan | 251/58 |
| 1,656,183 | 1/1928 | Enz | 251/58 |
| 2,809,011 | 10/1957 | Davis | 251/233 |
| 2,883,146 | 4/1959 | Knox | 251/172 |
| 2,926,035 | 2/1960 | Peickii et al. | 277/164 |
| 2,965,354 | 12/1960 | Grove et al. | 251/173 |
| 3,317,179 | 5/1967 | Willis | 251/58 |
| 3,653,670 | 4/1972 | Sifri et al. | 277/164 |
| 3,719,344 | 3/1973 | Jones et al. | 251/174 |
| 3,813,105 | 5/1974 | McQueen | 277/164 |
| 3,902,694 | 9/1975 | Friedell | 251/58 |
| 4,071,220 | 1/1978 | Iino | 251/174 |
| 4,137,935 | 2/1979 | Snowdon | 137/242 |
| 4,383,546 | 5/1983 | Walters, Jr. | 137/240 |
| 4,508,356 | 4/1985 | Janian | 277/164 |

FOREIGN PATENT DOCUMENTS

| | | | |
|---|---|---|---|
| 520188 | 4/1926 | Fed. Rep. of Germany | 251/172 |
| 2066931 | 7/1981 | United Kingdom | 251/198 |

*Primary Examiner*—G. L. Walton

*Attorney, Agent, or Firm*—Flynn, Thiel, Boutell & Tanis

[57] ABSTRACT

A valve assembly for powdery granules comprises a valve housing having upper and lower walls formed with upper and lower openings, a valve member having a hollow cylindrical valve body rotatably supported within the valve housing, and a drive mechanism for turning the valve member through an angular range of about 90° so as to hold the valve member upright in the vertical direction. The valve housing has, at the peripheral edge of its upper opening, a tapered surface which is enlarged downwards, and a circular groove is formed behind the tapered surface. Arranged in the circular groove is an elastic hollow seal ring, part of which is permitted to protrude into the interior of the valve housing through a circular slit formed in the tapered surface. The valve body have, at the peripheral edges of one end opening and a closure member mounted to the outer periphery of the valve body orthogonally to the axis thereof, a tapered surfaces to be opposed to the tapered surface provided at the upper opening peripheral edge of the valve housing. When the tapered surface of the valve housing opposes the tapered surface of the valve member, air is supplied to the interior of the seal ring to press the seal ring against the tapered surface of the valve member.

11 Claims, 8 Drawing Figures

VALVE ASSEMBLY FOR POWDERY GRANULES

FIELD OF THE INVENTION

The present invention relates to a valve assembly connected to a conduit for transport of powdery granules such as powdered coal.

BACKGROUND OF THE INVENTION

A valve assembly of this type has hitherto been known which is disclosed in the specification of U.S. Pat. No. 4,137,935. In this known valve assembly, as shown in FIG. 1, a dome-like valve member 104 is rotatably supported within a valve housing 102 attached to an inlet port of a pressure-vessel 101. The valve member 104 opens or closes a circular aperture 103 formed in an upper wall of the valve housing 102. A seal ring 105, directed inwards, is arranged in the peripheral edge of the circular aperture 103 and it engages the outer surface of the valve member 104. Reference numerals 106 and 107 denote a hopper and a drive shaft, respectively.

This known valve assembly is satisfactory for relatively massive powdery granules but unsatisfactory for fine powdery granules. More particularly, when transporting the fine powdery granules under a full-open state of the valve as shown in FIG. 1, the fine powdery granules supplied from the hopper 106 and entering into the interior of the valve housing 102 through the circular aperture 103 come in contact with the substantially entire surface of the seal ring 105 except for a portion thereof covered with the valve member 104. As a result, the seal ring 105 will disadvantageously be abraded and become nondurable for long-term use.

SUMMARY OF THE INVENTION

The present invention contemplates the elimination of the drawbacks of the prior art valve assembly and has for its object to provide a valve assembly wherein during the full-open, the seal ring is not exposed to flowing powdery granules so that under the full-open and full-close states, the seal ring can be prevented from being adhered with the powdery granules, and throughout the overall use of the valve, the seal ring is merely slightly exposed in the course of transfer of the full-open state to the full-close state or vice versa and hence the valve member is transferred without making sliding contact with the seal ring so that the adherence of the powdery granules to the seal ring and abrasion of the seal ring due to sliding contact thereof with the valve member can be prevented, whereby the long-term use of the seal ring can be assured without the necessity of exchange thereof, thereby reducing the time for exchange of the seal ring and saving cost therefor.

According to the present invention, the above object can be accomplished by a valve assembly for powdery granules comprising: a valve housing having upper and lower walls formed with upper and lower openings; a valve member having a hollow cylindrical valve body defining a passage of the powdery granules supplied from the upper opening to the lower opening and rotatably supported within the valve housing; and drive means, mounted to the valve housing, for turning the valve member through an angular range of about 90° so as to hold the valve member upright in the vertical direction, wherein the valve housing has, at the peripheral edge of its upper opening, a tapered surface which is enlarged downwards; a circular groove is formed behind the tapered surface; an air charge/discharge member is connected to the circular groove; the circular groove communicates with the interior of the valve housing through a circular slit formed in the tapered surface; an elastic hollow seal ring is arranged in the circular groove, part of the elastic hollow seal ring being permitted to protrude into the interior of the valve housing through the circular slit; a plurality of air holes perforate through part of the peripheral surface of the seal ring on the opposite side to the circular slit; the valve body has, at the peripheral edge of one end opening, a tapered surface to be opposed to the tapered surface of the valve housing; and a dome-shaped closure member, directed substantially orthogonally to the passage, is mounted to the outer periphery of the valve body, the closure member having, at its peripheral edge, a tapered surface to be opposed to the tapered surface of the valve housing, whereby in a full-open position where the tapered surface at the peripheral edge of one end opening of the valve member opposes the tapered surface of the valve housing or in a full-close position where the tapered surface of the closure member opposes the tapered surface of the valve housing, a pressurized fluid from the air charge/discharge member is supplied to the interior of the seal ring through the air holes to provide sealing between the valve housing and the valve member or between the valve housing and the closure member. Namely, under the full-open state, the tapered surface at the upper opening of the valve housing opposes the tapered surface at one end opening edge of the valve member, and a gap between both the tapered surfaces is sealed by the seal ring which is supplied, interiorly thereof, with the pressurized fluid to expand and partly project from the tapered surface at the upper opening. In this phase, the entirety of the seal ring is not exposed to the flowing powdery granules, in contrast to the seal ring of the prior art valve. During transfer between the full-open position and full-close position, the seal ring is removed of the internal pressurized fluid and constricted so as to be prevented from the sliding engagement with the valve member, thereby suppressing abrasion of the seal ring.

Another object of this invention is to provide a valve assembly wherein drive power for transfer of the valve member between the full-open and full-close positions can be reduced, the valve member can be held stably at the full-open and full-close positions, and the transfer of the valve member by an actuation means can be stopped automatically when the valve member reaches either the full-open position or the full-close position.

The above object can be accomplished by an embodiment of the invention wherein the valve body has a horizontal drive shaft and a horizontal supporting shaft which are rotatably supported by the valve housing to extend orthogonally to the closure member, protruding beyond the valve housing, and the drive means for valve member comprises an inverted T-shaped lever having a lever which extends in a direction opposite to the closure member and has, at its tip end, a balance weight, and a branched lever which extends upwards from an intermediate portion of the lever, and an actuation means connected to the branched lever, and wherein an index means is provided at the tip end of the drive shaft or of supporting shaft protruding beyond the valve housing, and a pair of detecting means are provided exteriorly of the valve housing, the detecting means being actuated by the index means to stop the actuation means when the valve member is brought into the full-open position or the full-close position. Namely, by connecting the intermediate branched lever to the actuation means and balancing the closure member and the balance weight which are respectively mounted to the opposite ends of the lateral lever from which the branched lever branches, the generation of torque in only one direction due to the closure member can be prevented, and the actuation means can be stopped by the signal from the index means under the full-open state or the full-close state.

According to a preferred embodiment, the closure member and the valve body are formed independently and the closure member is removably mounted to the valve body, so that when one of these members is damaged, the two members are disassembled for repairment of the damaged member or exchange thereof with new one, thereby saving time and cost therefor; a plurality of air passages are formed in the lower peripheral wall of the valve housing and the transport conduit is installed obliquely, so that when powdery granules are accumulated on the bottom of the valve housing, air is admitted into the valve housing through the air holes to blow away the powdery granules; and between the valve body and the bearing arrangements of the valve housing, seal members are provided to surround the drive and supporting shafts, so that intrusion of the powdery granules into the bearing arrangements can be prevented to suppress abrasion of the bearing arrangements.

According to another embodiment of the invention, a guide ring is mounted to the peripheral edge of an upper opening of a lower cylindrical portion constituting the valve housing, so that even when powdery granules are supplied through either the upper cylindrical portion or the lower cylindrical portion, both the upper peripheral end of the lower cylindrical portion and the lower flange of the valve body can be protected from damage due to collision of the powdery granules, thereby eliminating unnecessary time and cost for repairment of the damage.

DESCRIPTION OF PREFERRED EMBODIMENTS

The present invention will now be described by way of example.

Figure 5:
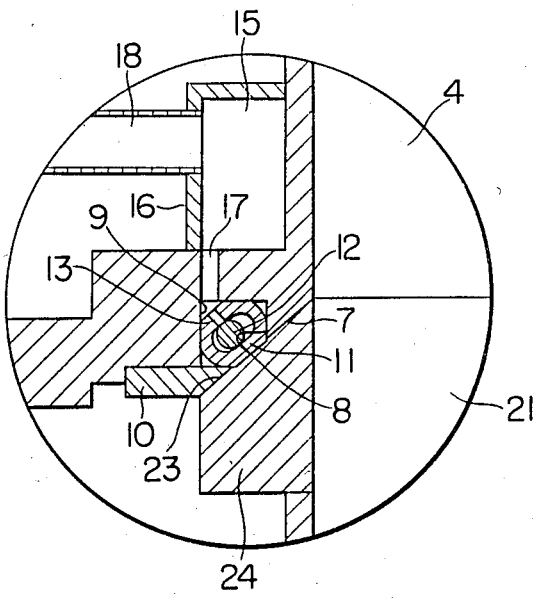
FIG. 5 is an enlarged sectional view showing a portion V of the FIG. 2 embodiment.

Referring now to FIGS. 2 to 5, a valve housing 1 has a lower valve housing 2 and an upper valve housing 3 fixed thereto. An upper cylindrical portion 4 and a lower cylindrical portion 5 having the same diameter are respectively connected to upper and lower walls of the valve housing 1 to oppose to each other, thereby forming upper and loer openings. The valve casing 1 is connected to conduits for powdery granules, not shown, through both the cylindrical portions 4 and 5. As best shown in FIG. 5, the lower peripheral edge of the upper cylindrical portion 4 is formed with a tapered surface 7 which is enlarged downwards. A circular groove 9 is formed in the wall of the upper valve housing 3 behind the tapered surface 7. Formed in the tapered surface 7 is a circular slit 8 through which the circular groove 7 communicates with the interior of the valve housing 1.

A plastically deformable hollow seal ring 11 is seated in the circular groove 9 and held therein by means of a stiffening ring 12 passing through the interior of the hollow seal ring 11 and a ring holder 10 surrounding the hollow seal ring 11 exteriorly thereof. Part of the hollow seal ring 11 is permitted to protrude into the interior of the valve housing through the circular slit 8. A plurality of air holes 13 perforate through part of the peripheral surface of seal ring 11 on the opposite side to the circular slit 8. Above the circular groove 9 and outside the upper cylindrical portion 4, a circular chamber 15 is built with a circular enclosure 16. This circular chamber 15 communicates with a portion of the circular groove 9 facing the air holes 13 through an air passage 17 formed in the wall of the upper valve housing 3. Connected to the circular chamber 15 is an air pipe 18 which is turn is connected with an air charge/discharge means not shown. When the air charge/discharge means is operated, air is supplied to or discharged from the interior of the seal ring 11 through the circular chamber 15, air passage 17, circular groove 9 and air holes 13.

On the other hand, a valve member 20 is housed within the valve housing 1. The valve member 20 comprises a hollow valve body 21 being substantially identical in diameter with the cylindrical portions 4 and 5 and having openings at opposite ends with one end confronting the vicinity of the upper cylindrical portion 4 and the other end confronting the vicinity of the lower cylindrical portion 5, and a dome-shaped closure member 22 secured to the outer peripheral surface of the valve body 21 orthogonally to the axis line thereof and figured to close the opening of the upper cylindrical portion 4. The valve member 20 is rotatable through 90° between a full-open position (FIG. 2) where the opposite end openings of the valve body 21 are aligned with the end openings of the two cylindrical portions 4 and 5 and a full-close position (FIG. 7) where the closure member 22 closes the opening of the upper cylindrical portion 4. The valve body 21 has, at its opposite ends, flanges 24 formed with tapered surfaces 23 at their outer peripheral edges and the tapered surface 23 at one end opposes the tapered surface 7 of the upper cylindrical portion 4 under the full-open state. Reference numeral 25 denotes a passage formed inside the valve body 21. The closure member 22 has, at its outer peripheral edge, a tapered surface 27 which opposes the tapered surface 7 of the upper cylindrical portion 4 under the full-closed state. The closure member 22 has, at its inner peripheral edge, a pair of holding portions 28 and removably mounted, by way of the holding portions 28, to a pair of brackets 29 projecting from the middle portions on the outer peripheral surface of the valve body 21 by means of bolts and nuts, for example, in such a manner that the closure member 22 straddles over the outer peripheral surface of the valve body 21.

Figure 3:
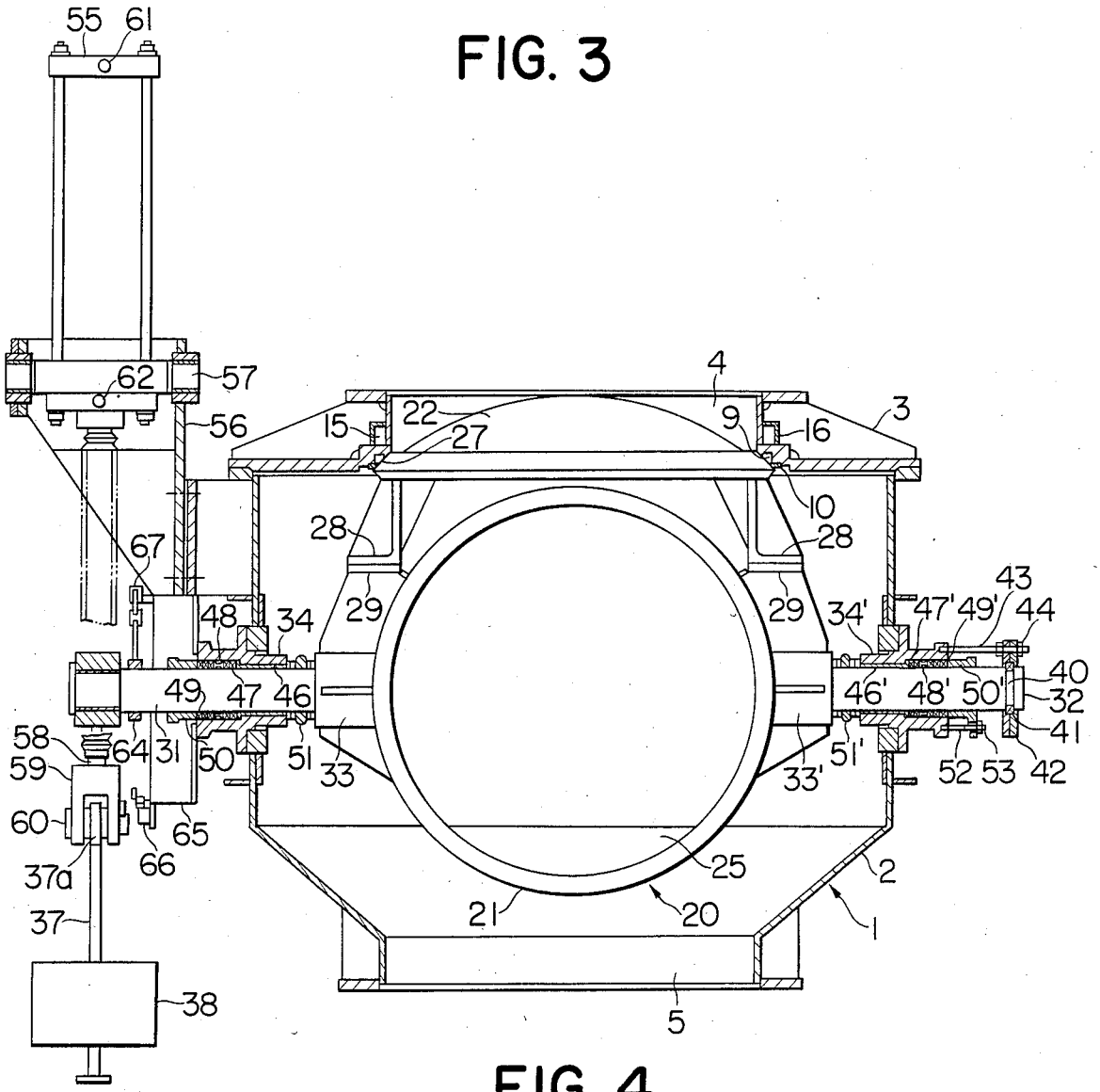
FIG. 3 is a right side view, partly longitudinally sectioned, of the FIG. 2 embodiment.
Figure 4:
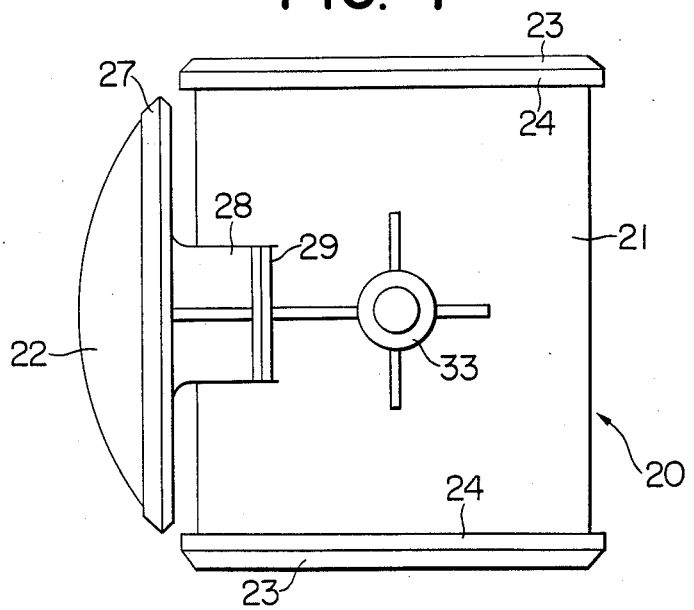
FIG. 4 is a front view showing a valve member of the FIG. 2 embodiment.

Referring to FIG. 3, a valve drive shaft 31 and a valve supporting shaft 32 are horizontally secured to the middle portions on the outer peripheral surface of the valve body 21 which is orthogonal to the closure member 22, and these shafts oppose to each other. The valve drive shaft 31 has one end fixed to a boss 33 of the valve body 21 and the other end rotatably supported by a bearing arrangement 34 to protrude beyond the valve housing 1. Similarly, one end of the valve supporting shaft 32 is fixed to a boss 33' of the valve body 21 and the other end of the shaft 32 is rotatably supported by a bearing arrangement 34' to protrude beyond the valve housing 1. Fixed to the end of the valve drive shaft 31 protruding beyond the valve housing 1 is a base end of a lateral lever portion of a T-shaped lever 37 whose tip end, opposite to the base end, is fixedly mounted with a balance weight 38. The balance weight 38 balances with torque of the valve member 20 exerting on the valve drive shaft 31. The end of the valve supporting shaft 32 protruding beyond the valve housing 1 is formed with a circular groove 40 in which a support ring 41 is slidably fitted. The support ring 41 is connected to the bearing arrangement 34' through a ring holder 42. A tip end of an adjusting bolt 43, which is mounted to the outer end surface of the bearing arrangement 34' to extend in parallel with the axis of the valve shaft 32, penetrates through the ring holder 42, and the ring holder 42 is adjustable in its position by means of the adjusting bolt 43 and a nut 44. The bearing arrangement 34 comprises a bush 46, a packing 47, a lantern ring 48, a packing 49, a packing gland 50, and a seal member 51. Similarly, the bearing arrangement 34' comprises a bush 46', a packing 47', a lantern ring 48', a packing 49', a packing gland 50', and a seal member 51'. The seal member 51 or 51' is adapted to prevent intrusion of powdery granules into the bearing arrangement 34 or 34'. An adjusting bolt 52 mounted to the outer end surface of the bearing arrangement 34' has a tip end which penetrates through a hole formed in the packing gland 50' and is applied with a nut 53 for fixing the packing gland 50'.

Figure 1:
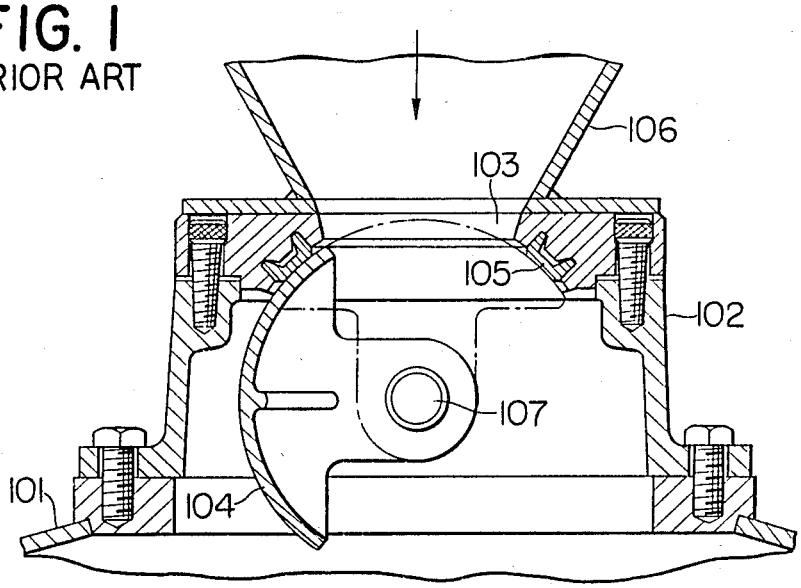
FIG. 1 PRIOR ART
FIG. 1 is a fragmentary sectional view showing a typical example of a prior art valve assembly for powdery granules.
Figure 2:
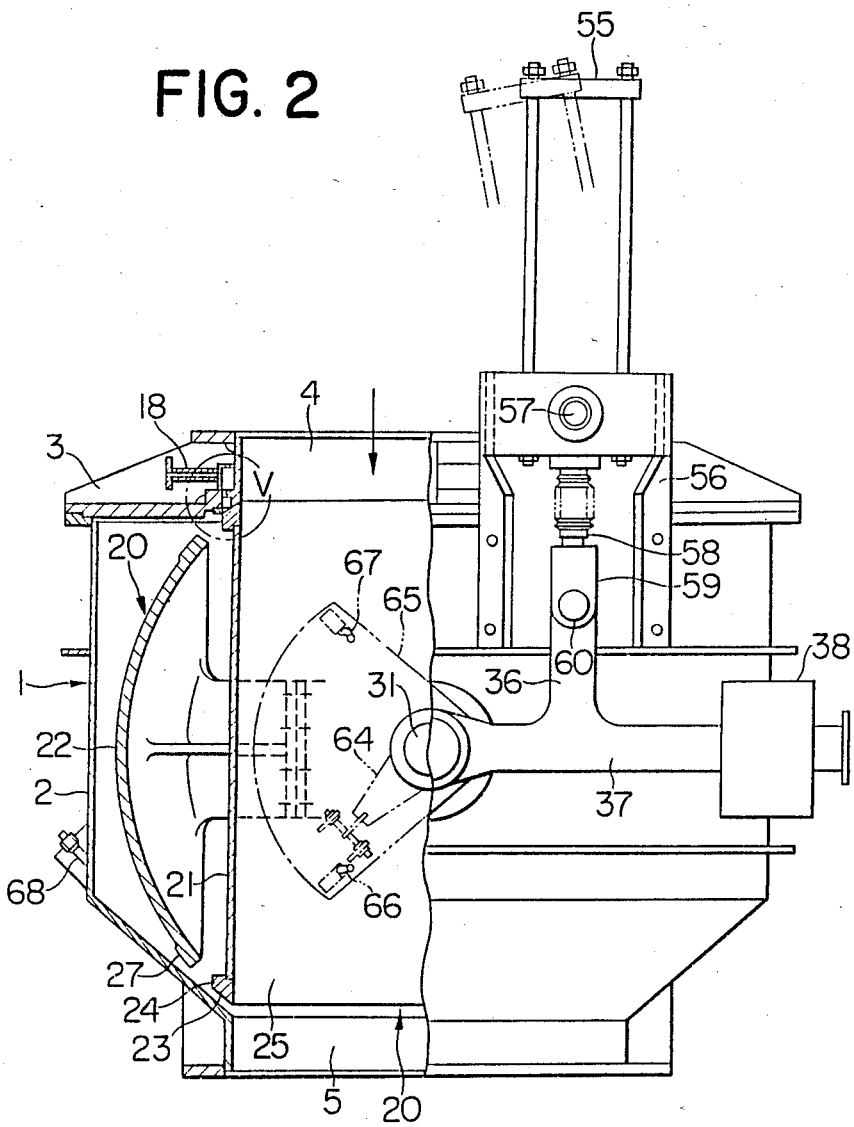
FIG. 2 is a front view, partly longitudinally sectioned, of a valve assembly for powdery granules according to an embodiment of the invention.

A drive air cylinder 55 is swingably mounted on a horizontal hinge pin 57 which is supported by a bracket 56 fixed to the lower valve housing 2. Connected to a tip end of a piston rod 58 of this air cylinder 55 is a forked connecting member 59 which is coupled, by means of a pin 60, with a tip end of a branched lever 36 that branches upwards from an intermediate portion of the T-shaped lever 37 (FIG. 2). Upper and lower portions of the cylinder 55 are perforated with air holes 61 and 62, respectively.

A cam 64 standing for an index means and fixed to the valve drive shaft 31 follows the rotation of the valve shaft 31 to engage or disengage a limit switch 66 for opening mounted on a lower end portion of a supporting member 65, sectoral in front view, and a limit switch 67 for closing mounted on an upper end portion of the supporting member 65. This supporting member 65 is fixed to the lower valve housing 2 through the bearing arrangement 34. A plurality of air, passages 68 are provided in the wall contiguous to an inclined bottom wall of the lower valve housing 2. If the transport conduit is installed slightly obliquely, powdery granules accumulated on the bottom of the valve housing 2 can be forcibly blown away toward the lower cylindrical portion 5 by admitting air pressurized in excess of a pressure within the transport conduit into the valve housing 2 through the plurality of air passages 68. The cam 64 may otherwise be mounted to the valve supporting shaft 32 in lieu of the valve drive shaft 31.

The operation of the embodiment described so far will now be described.

In the full-open state shown in FIG. 2, air from the air pipe 18 is supplied to the interior of the seal ring 11 via the circular chamber 15, air passage 17, circular groove 9 and air holes 13 so that the seal ring 11 is pressurized beyond the pressure within the transport conduit. As a result, the seal ring 11 partly projects through the circular slit 8 to closely engage the tapered surface 23 formed at the one end of the valve body 21. Therefore, the powdery granules supplied from the upper cylindrical portion 4 of the valve casing 1 are discharged to the conduit on the downstream through the passage 25 of the valve body 21. At this time, the powdery granules almost never make contact to the seal ring 11.

Figure 6:
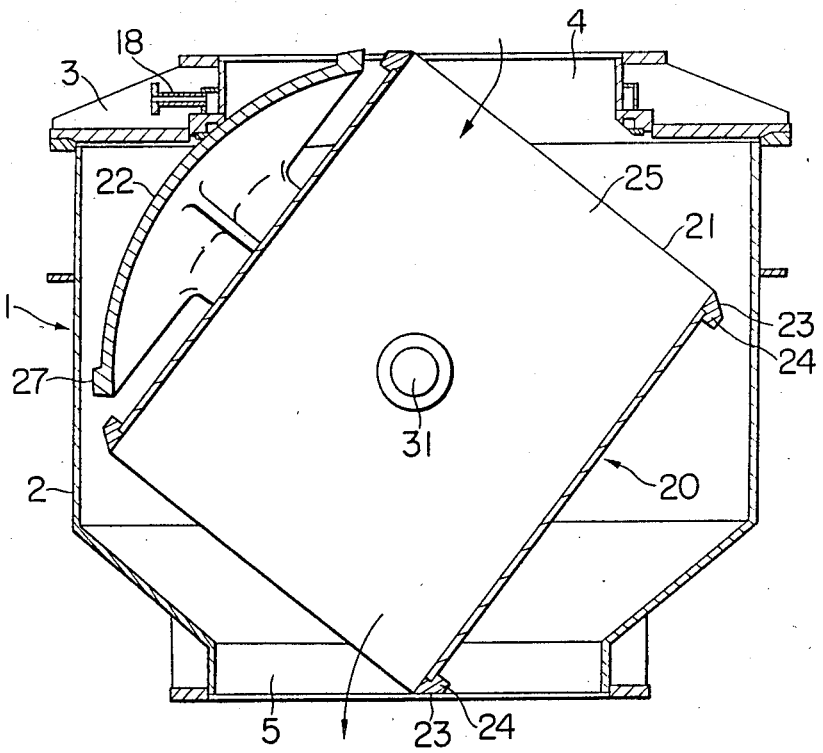
FIG. 6 is a sectional view showing a state of the valve member during its turning in the embodiment of FIG. 2.
Figure 7:
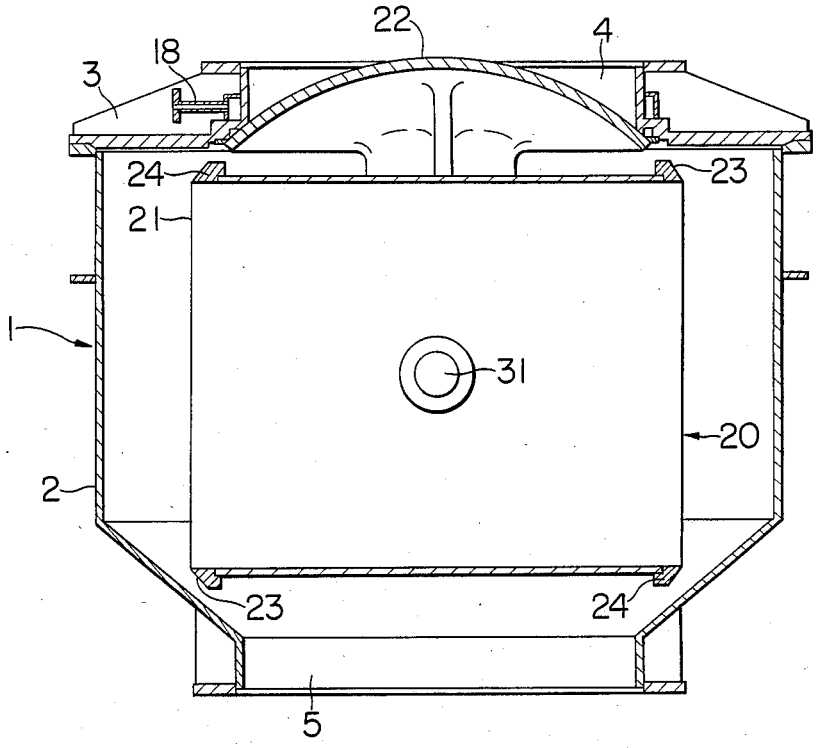
FIG. 7 is a sectional view showing a full-close state in the embodiment of FIG. 2.

Next, to transfer the full-open state to the full-close state, the air prevailing in the seal ring 11 is discharged to the outside via the air holes 13, circular groove 9, air passage 17, circular chamber 15 and air pipe 18 to decrease the pressure within the seal ring 11 to below the pressure within the transport conduit. As a result, the seal ring 11 is constricted and released from the close engagement with the tapered surface 23 of the valve body 21. Thereafter, air is supplied to the air hole 61 of the air cylinder 55. Then, the piston rod 58 is advanced to turn the T-shaped lever 37 downwards so that the valve member 20 is gradually turned clockwise for closure through the valve drive shaft 31 fixed to the base end of the lever 37 (FIG. 6). When the valve member 20 has been turned through approximately 90°, the cam 64 engages the limit switch 67 for closing to detect that the valve member 20 has reached the full-close position. Concurrently therewith, the supply of air to the air hole 61 is stopped to deactuate the air cylinder 55, thereby establishing the full-close state (FIGS. 3 and 7). Thereafter, the air from the air pipe 18 is reapplied to the interior of the seal ring 11 so that the seal ring 11 is pressurized beyond the pressure within the conduit to cause part of the seal ring to project through the circular slit 8 and closely engage the tapered surface 27 of the closure memoer 22. Consequently, the passage is completely shut by the closure member 22 to prevent the powdery granules from flowing to the downstream conduit.

Further, to transfer the full-close state to the full-open state, the internal air of the seal ring 11 is discharged to the outside in the same manner as described in the precedence to decrease the internal pressure of the seal ring to below the pressure within the conduit. As a result, the seal ring 11 is constricted and released from the close engagement with the tapered surface 27 of the closure member 22. Subsequently, air is supplied to the air hole 62 of the air cylinder 55. Then, the piston rod 58 is retracted to turn the drive lever 37 upwards so that the valve 20 is gradually turned counterclockwise for opening. When the valve member 20 has been turned through approximately 90°, the cam 64 engages the limit switch 66 for opening to detect that the valve member 20 has reached the full-open position. Concurrently therewith, the supply of air to the air hole 62 is stopped, thereby establishing the full-open state. Thereafter, the air from the air pipe 18 is again supplied into the seal ring 11 so that the seal ring 11 is pressurized beyond the pressure within the conduit to cause part of the seal ring to project through the circular slit 8 and closely engage the tapered surface 23 of the cylindrical portion 21.

In this manner, under the full-open state or full-close state, the seal ring 11 is completely protected from contacting the powdery granules. If the powdery granules partly leaks to the interior of the valve housing 1 through a gap between the inclined bottom wall of the lower valve housing 2 and the lower flange 24 of the valve member 20, contacting of the seal ring 11 with the leaked powdery granules will take place within only a slight time interval during which the valve member 20 is driven to turn.

Figure 8:
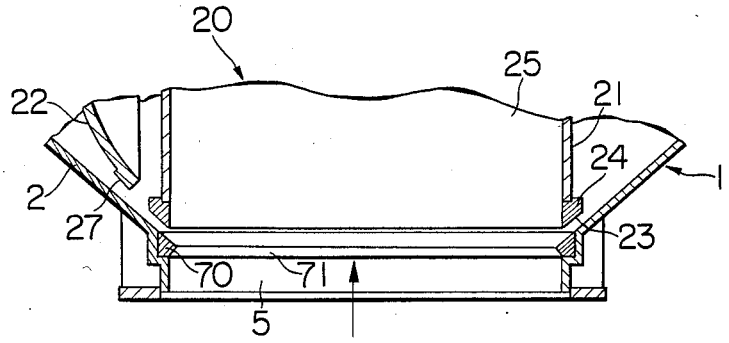
FIG. 8 is a fragmentary sectional view showing a lower opening under a full-open state in a valve assembly for powdery granules according to another embodiment of the invention.

In the foregoing, a case has been described wherein the valve assembly is connected with the transport conduit of the type for supplying the powdery granules through the upper cylindrical portion 4. Conversely, the powdery granules may advantageously be supplied through the lower cylindrical portion 5 according to a modified embodiment to be described with reference to FIG. 8. More particularly, in the modification of FIG. 8, a guide ring 70 having a tapered surface 71, which is decreased in diameter toward the interior of the lower cylindrical portion 5, is fixed to the peripheral edge of the lower cylindrical portion 5. With this guide ring 70, the powdery granules can be supplied efficiently to the passage 25 of the valve body 21 by way of the tapered surface 71. In addition, when the powdery granules are supplied through the upper cylindrical portion 4 or the lower cylindrical portion 5, these granules will collide against the guide ring 70 but will not collide against the upper end of the lower cylindrical portion 5 or the lower flange 24 of the valve body 21, thereby preventing the powdery granules from doing damage to the upper end of the lower cylindrical portion 5 or the flange 24 of the valve body 21. This eliminates the necessity of troublesome and expensive working for repairing or exchanging the portion 5 or flange 24 in the event that the lower cylindrical portion 5 or flange 24 would otherwise be damaged. Instead, there is a tendency that the guide ring 70 will be damaged, but the damaged guide ring 70 can be repaired or exchanged with a new one easily and inexpensively.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A valve assembly for powdery granules comprising:

a valve housing having upper and lower walls formed with upper and lower openings;

a valve member having a hollow cylindrical valve body defining a passage for the powdery granules supplied from said upper opening to said lower opening and rotatably supported within said valve housing; and drive means, mounted to said valve housing, for turning said valve member through an angular range of about 90° so as to hold said valve member upright in the vertical direction, wherein said valve housing has, at the peripheral edge of its upper opening, a tapered surface which is enlarged downwards; a circular groove is formed behind the tapered surface; an air charge/-discharge member is connected to said circular groove; said circular groove communicates with the interior of said valve housing through a circular slit formed in said tapered surface; an elastic hollow seal ring is arranged in said circular groove, part of said elastic hollow seal ring being permitted to protrude into the interior of said valve housing through said circular slit; a stiffening ring is housed in the interior of said elastic hollow seal ring to stiffen said seal ring so as to hold said elastic hollow seal ring in said circular groove during the insertion of said seal ring into the valve assembly; means securable for holding said seal ring in said groove during used of the valve assembly; a plurality of air holes perforate through part of the peripheral surface of said seal ring on the opposite side to said circular slit; said stiffening ring being loosely confined and free floating in said hollow seal ring to allow free entry and exit of a pressurized fluid into and out of said hollow seal ring through said air holes; said valve body has, at the peripheral edge of one end opening, a tapered surface to be opposed to said tapered surface of said valve housing; and a dome-shaped closure member, directed substantially orthogonally to said passage, is mounted to the outer periphery of said valve body, said closure member having, at its outer peripheral edge, a tapered surface to be opposed to said tapered surface of said valve housing, whereby in a full-open position where said tapered surface at the peripheral edge of one end opening of said valve member opposes said tapered surface of said valve housing or in a full-close position where said tapered surface of said closure member opposes said tapered surface of said valve housing, said pressurized fluid is supplied to the interior of said seal ring through said air holes from said air charge/discharge member to provide sealing between said valve housing and said valve member or between said valve housing and said closure member.

2. A valve assembly for powdery granules according to claim 1 wherein said valve body has a horizontal drive shaft and a horizontal supporting shaft which are rotatably supported by said valve housing to extend orthogonally to said closure member, protruding beyond said valve body, and wherein said drive means for said valve member comprises a rigid, inverted T-shaped lever having an elongate lateral portion having a base end fixed to the protruding end of said drive shaft, said lever portion extending away from said base end and said closure member, said lever portion having an opposite tip end carrying a balance weight, said T-shaped lever having a branch which extends fixedly upwards from an intermediate part of said lateral portion, and an actuation means pivotally fixed to said branched lever.

3. A valve assembly for powdery grahules according to claim 2 wherein an index means is provided at the tip end of said drive shaft or supporting shaft protruding beyond said valve housing, and a pair of detecting means are provided exteriorly of said valve housing, said detecting means being actuated by said index means to stop said actuation means when said valve member is brought into the full-open position or the full-close position.

4. A valve assembly for powdery granules according to claim 2 wherein each of said drive shaft and supporting shaft is rotatably supported by a bearing arrangement, and seal members for surrounding said drive and supporting shafts are provided between said valve body and said bearing arrangements.

5. A valve assembly for powdery granules according to claim 2 including means for forcibly blowing away, toward the lower opening of the valve housing, powdery granules accumulated in the bottom portion of the valve housing, such means comprising a plurality of air passages in the valve housing lower peripheral wall for admitting air to the interior of said valve housing.

6. A valve assembly for powdery granules according to claim 2 including a guide ring mounted to the upper peripheral edge of the lower opening of said valve housing, said guide ring protruding radially inward beyond the adjacent edges of said housing lower opening and valve body for absorbing impacts from granules passing through said valve body and thus defending said adjacent edges of said valve body and housing lower opening from said impacts.

7. A valve assembly for powdery granules according to claim 1 wherein said closure member is removably attached to the outer periphery of said valve body.

8. A valve assembly for powdery granules according to claim 2 wherein said closure member is removably attached to the outer periphery of said valve body.

9. A valve assembly for powdery granules according to claim 1 including means for forcibly blowing away, toward the lower opening of the valve housing, powdery granules accumulated in the bottom portion of the valve housing, such means comprising a plurality of air passages in the valve housing lower peripheral wall for admitting air to the interior of said valve housing.

10. A valve assembly for powdery granules according to claim 1 including a guide ring mounted to the upper peripheral edge of the lower opening of said valve housing, said guide ring protruding radially inward beyond the adjacent edges of said housing lower opening valve body for absorbing impacts from granules passing through said valve body and thus defending said adjacent edges of said valve body and housing lower opening from said impacts.

11. A valve assembly for powdery granules according to claim 1 wherein said elastic hollow seal ring and its interior are of oval cross section elongated along said tapered surface of said valve housing as installed in said circular groove, said stiffening ring being of generally circular cross section and leaving air space beside it in the interior of said elastic hollow sealing ring in a direction along said tapered surface of said valve housing.

* * * * *

UNITED STATES PATENT AND TRADEMARK OFFICE

CERTIFICATE OF CORRECTION

PATENT NO. : 4 583 568

DATED : April 22, 1986

INVENTOR(S) : Takashi YAMAKAWA et al

It is certified that error appears in the above-identified patent and that said Letters Patent is hereby corrected as shown below:

Column 8, line 20, "used" should read -- use --.

Signed and Sealed this

*Sixteenth* Day of *September 1986*

[SEAL]

*Attest:*

DONALD J. QUIGG

*Attesting Officer*

*Commissioner of Patents and Trademarks*